US008540091B2

(12) United States Patent
Kristensen

(10) Patent No.: US 8,540,091 B2
(45) Date of Patent: Sep. 24, 2013

(54) BLANK FOR A RACK

(76) Inventor: Teddy Kristensen, Smørum (DK)

( * ) Notice: Subject to any disclaimer, the term of this patent is extended or adjusted under 35 U.S.C. 154(b) by 1276 days.

(21) Appl. No.: 12/282,335

(22) PCT Filed: Mar. 9, 2007

(86) PCT No.: PCT/IB2007/050793
§ 371 (c)(1),
(2), (4) Date: Sep. 9, 2008

(87) PCT Pub. No.: WO2007/105160
PCT Pub. Date: Sep. 20, 2007

(65) Prior Publication Data

US 2009/0090685 A1 Apr. 9, 2009

(30) Foreign Application Priority Data

Mar. 13, 2006 (DK) ..... 2006 00354

(51) Int. Cl.
*A47F 5/10* (2006.01)

(52) U.S. Cl.
USPC ..... 211/149; 211/135; 248/174; 312/258

(58) Field of Classification Search
USPC ..... 211/70.01, 71.01, 72, 73, 90.01, 211/90.04, 135, 149, 150, 168, 126.5, 133.3; 312/258, 259, 262; 220/62; 248/459, 150, 248/174; 108/162, 165, 115, 134, 193; 229/931, 406; D6/473–476
See application file for complete search history.

(56) References Cited

U.S. PATENT DOCUMENTS

| | | | | | |
|---|---|---|---|---|---|
| 1,759,862 | A | * | 5/1930 | Moore | 211/50 |
| 1,983,700 | A | * | 12/1934 | Lackey | 220/6 |
| 2,155,190 | A | * | 4/1939 | Heinz | 211/135 |
| 2,867,048 | A | * | 1/1959 | Holtzman | 40/312 |
| 2,918,178 | A | * | 12/1959 | Leone | 211/195 |
| 4,080,907 | A | * | 3/1978 | Kaufman | 108/59 |
| 4,311,100 | A | | 1/1982 | Gardner et al. | 108/111 |
| 4,493,424 | A | * | 1/1985 | Smith | 211/149 |
| 4,570,805 | A | * | 2/1986 | Smith | 211/149 |
| 4,582,003 | A | * | 4/1986 | Valero | 108/179 |
| RE32,668 | E | * | 5/1988 | Smith | 211/149 |
| 5,016,545 | A | * | 5/1991 | Robertson et al. | 108/179 |
| 5,145,244 | A | * | 9/1992 | Kersting et al. | 312/259 |
| 5,193,466 | A | * | 3/1993 | Eder | 108/166 |
| 5,315,936 | A | * | 5/1994 | Smith | 108/165 |

(Continued)

FOREIGN PATENT DOCUMENTS

| | | | |
|---|---|---|---|
| DE | 41 18 483 | A1 | 10/1992 |
| DE | 298 06 918 | U1 | 7/1998 |

(Continued)

OTHER PUBLICATIONS

International Search Report PCT/IB2007/050793 Dated Sep. 28, 2007.

*Primary Examiner* — Joshua Rodden
(74) *Attorney, Agent, or Firm* — Winston & Strawn LLP

(57) ABSTRACT

A blank for a rack with at least one shelf designed as a starting plate with at least one bending region in the form a number of segments and openings. The starting plate includes a number of elements which each have a side extending along a bending region while the other sides of the element are free whereby the rack is quickly and easily formed by bending these elements about their bending regions.

14 Claims, 11 Drawing Sheets

(56) References Cited

U.S. PATENT DOCUMENTS

| | | | | |
|---|---|---|---|---|
| 5,316,156 | A * | 5/1994 | Land et al. | 211/149 |
| 5,458,411 | A * | 10/1995 | Moss | 312/259 |
| 5,660,404 | A * | 8/1997 | Dilley | 280/47.32 |
| 5,669,683 | A * | 9/1997 | Moss et al. | 312/259 |
| 5,678,492 | A * | 10/1997 | Pinkstone et al. | 108/165 |
| 5,697,506 | A * | 12/1997 | Peickert | 211/71.01 |
| 5,722,628 | A * | 3/1998 | Menaged | 248/441.1 |
| 5,826,732 | A * | 10/1998 | Ragsdale | 211/149 |
| 6,378,710 | B1 | 4/2002 | Grueneberg | 211/132.1 |
| 6,481,259 | B1 * | 11/2002 | Durney | 72/324 |
| 6,612,669 | B2 * | 9/2003 | Grueneberg | 312/259 |
| 6,715,623 | B2 * | 4/2004 | Broerman | 211/149 |
| 6,752,280 | B2 * | 6/2004 | Dye | 211/149 |
| 7,007,615 | B2 * | 3/2006 | Grueneberg | 108/165 |
| 7,252,200 | B1 * | 8/2007 | Hester | 211/72 |
| 2002/0108541 | A1 * | 8/2002 | Grueneberg | 108/115 |
| 2003/0160015 | A1 * | 8/2003 | Broerman | 211/149 |
| 2003/0209507 | A1 * | 11/2003 | Dye | 211/149 |
| 2004/0148825 | A1 * | 8/2004 | Myers et al. | 40/124 |
| 2005/0145587 | A1 * | 7/2005 | Matthews | 211/70.6 |
| 2007/0000854 | A1 * | 1/2007 | Virvo | 211/72 |
| 2007/0272639 | A1 * | 11/2007 | Alexander | 211/186 |

FOREIGN PATENT DOCUMENTS

| | | |
|---|---|---|
| FR | 2 886 823 | 12/2006 |
| WO | WO 97/48309 | 12/1997 |
| WO | WO 2004/110222 A2 | 12/2004 |

* cited by examiner

BLANK FOR A RACK

This application is a 371 filing of International Patent Application PCT/IB2007/050793 filed Mar. 9, 2007.

BACKGROUND ART

The invention relates to a blank for a rack with at least one shelf, comprising a starting plate of a permanently deformable material that the plate is formed with at least one bending region in the form of a number of segments and openings, that the plate is formed with a number of elements which each have a side that extends along a bending region while at least one of the remaining sides of the elements is free, and that the rack is formed by bending the elements about their bending regions.

Such racks are used to a large extent as exhibition stands for presentation of different objects, e.g. goods in a supermarket. Those companies or shops that use these stands often make use of many and will additionally regularly have a need for quickly and easily to, as a supplement, assemble more than those already in use.

However, exhibition stands take up space, which is usually valuable. Thus, for considerations of space they are regularly stocked in a planar condition.

By way of example can be mentioned the exhibition stands known from the patent documents U.S. Pat. No. 4,311,100 and WO 2004110222 that can be folded up of one single flat piece of cardboard.

However, these known stands have significant deficiencies in that they are difficult and time consuming to unfold and fold again. Furthermore, the stands are generally not sufficiently collapse resistant and stable. Additionally, cardboard is a very weak material, which is not very stable in use. Thus, an exhibition stand of cardboard will only have a comparatively short lifetime and will in the long run be expensive to use.

The patent document WO 97/48309 mentions a plate with a number of folding lines de limiting a number of elements. When folding about the respective folding lines a three-dimensional furniture structure is formed. It is indicated that the plate can be a rack with shelves. Stability and ability to carry a weight is achieved by means of bended flaps for strengthening the rack and tongues for interconnecting the elements. In many cases, the flaps are so long that it is not possible to bend them manually about the folding lines unless the plate is thin such as indicated in the patent document. The folding lines of the shelves are not constructed to take up the load, which influences the shelves in use. The known plate is difficult to unfold and assemble into, for example, a sustainable rack.

Similar complicated racks are known from U.S. Pat. No. 6,378,719 B1, German patent application DE 41 18 483 A1, and German utility model DE 29 806 918 U1.

SUMMARY OF THE INVENTION

A first aspect according to the invention consists in providing a blank of the kind mentioned in the opening paragraph, which is quickly and easily unfolded into a rack.

A second aspect according to the invention consists in providing a blank of the kind mentioned in the opening paragraph for constructing a strong and stable rack.

A third aspect according to the invention consists in providing a blank of the kind mentioned in the opening paragraph for constructing a collapse resistant and stable rack.

A fourth aspect according to the invention consists in providing a blank of the kind mentioned in the opening paragraph for constructing a rack with a long lifetime.

A fifth aspect according to the invention consists in providing a blank of the kind mentioned in the opening paragraph for cheaper construction of a rack than known hitherto.

The new and unique according to the invention consists in the fact that the at least one shelf is formed as a cantilevered bar which is restrained in the associated bending region, and that the plate comprises two opposing side elements which extend along each their bending region and which at bending about their respective bending regions form the sides of the rack.

The structure according to the invention advantageously results in that the rack quickly and easily can be formed simply by bending the different elements of the plate about their bending regions. Subsequently, the elements do not need to be connected further, as the segments of the bending regions in the present case are of a material, which can be formed with permanent deformations. In this state the bending regions are so strong that they by themselves can carry the proper weight of the shelves as well as the weight, which influences the shelves in use.

Thus, the rack is cheaper to produce than normally, as no time is spent on separate joinings and no costs are spent on joining means such as e.g. screws.

As the finished rack is produced of a material which can be formed with permanent deformations, such as a metal, it will be hard-wearing in use and achieve a long lifetime.

The bending regions can be formed with identical moments of resistance against bending but in a advantageous embodiment according to the invention the moments of resistance of the different bending regions can be determined in depending on the extent of the respective elements across its bending region, i.e. of the length of the torque arm as well as its purpose in the finished rack. Thus, the bending region of a shelf can advantageously have a large moment of resistance in order to enable the shelf to securely carry the weight of the goods, which are placed on the shelf.

More specific, according to the invention the bending region belonging to at least one shelf can be fitted with a moment of resistance which is equal to or larger than the bending moment, which the bending region is influenced by when the shelf is loaded with a predetermined maximal load divided by the maximum allowed specific strain for the material concerned.

The terms used in the following as designations for the different elements of the starting plate are derived from their function in the finished rack.

Thus, the shelf elements become shelves in the finished rack and the side elements the sides of the rack. The possible front edge of a shelf is formed by a front edge element and its possible rear edge is formed by a rear edge element.

In some cases the shelf has no rear edge. But in most cases there is a rear edge element, which is punched out of the same region on the starting plate as the shelf. Thus, both the rear edge and the shelf form a camlike configuration with rectangular or V-shaped teeth.

In an advantageously other embodiment according to the invention the shelf can be bent about the upper, seen in the upright position of the rack-bending region, in such a way that the shelf forms a united support, i.e. a support without openings where objects that are placed on the shelf could fall through.

In this case, according to the invention the rear edge can be formed by a non-unfolded region of the starting plate.

Other elements can according to the invention in an unfolded state form dividing walls for dividing the respective shelf into a compartment or to form book supports when the rack is used as a bookcase.

According to the invention a rack can be extended vertically by means of another rack, which is formed with hooks for engaging in the bending regions at the sides of the first rack and with a bending region on at least one rear edge element at the lowest shelf for allowing elements to be bent about a top element on the first rack. Thereby the two racks can quickly and easily be assembled without the use of tools and the achieved assembly will be secure and stable.

BRIEF DESCRIPTION OF THE DRAWINGS

The invention will be explained further below, describing an exemplary embodiment and giving further technical functions and advantages with reference to the drawings, in which.

DETAILED DESCRIPTION OF THE PREFERRED EMBODIMENTS

In the following it is assumed that the starting plate according to the invention is of iron and that the rack, which is formed of the starting plate, is an exhibition stand for presentation of goods to be sold in a shop.

Figure 2:
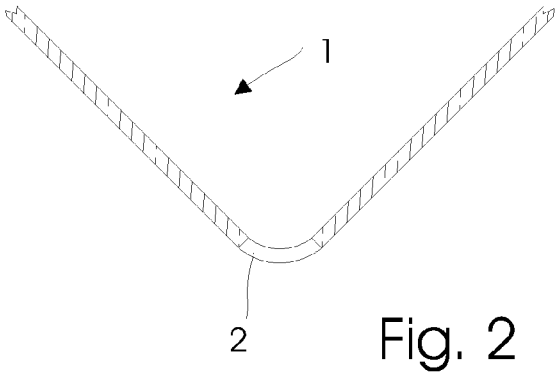
FIG. 2 is the starting plate of FIG. 1 in a bended state.
Figure 1:
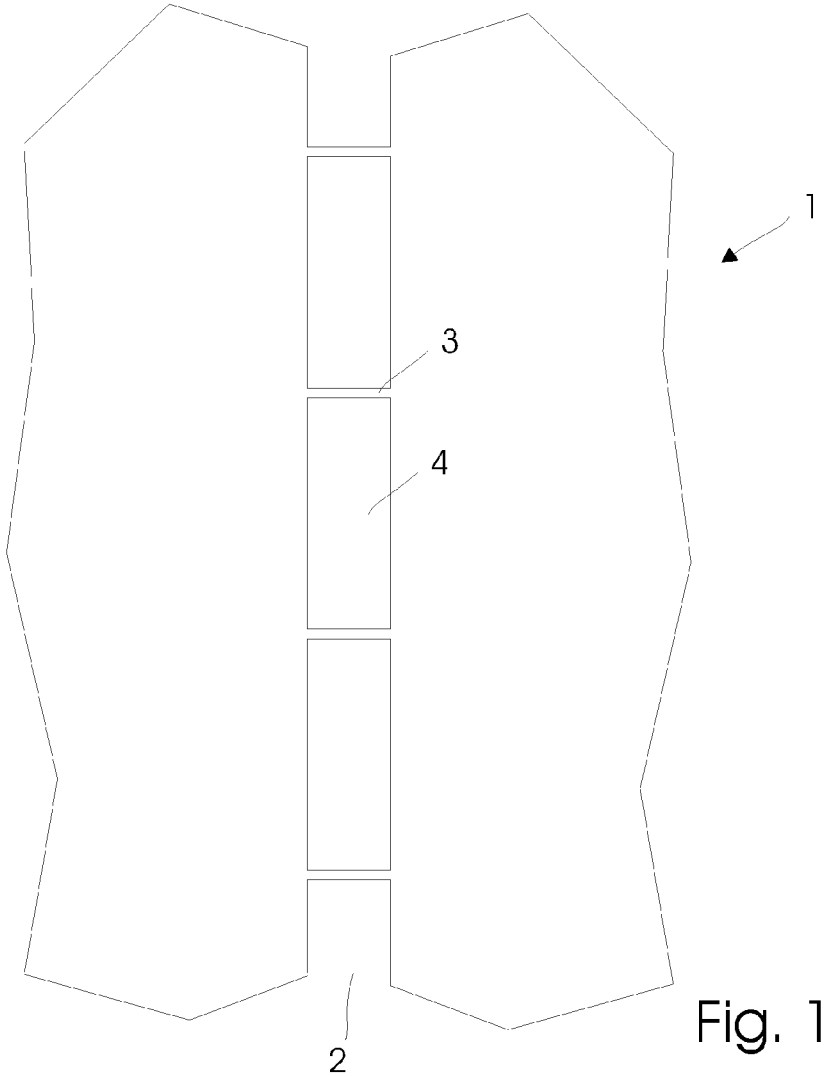
FIG. 1 is a fragmentary view in large scale of a starting plate according to the invention with a bending region.

FIG. 1 shows a fragment 1 of the starting plate with a bending region 2, and FIG. 2 shows the fragment bent about the bending region, which comprises a number of segments 3 separated by openings 4, which preferably are punched out by means of e.g. a CNC-punching machine.

The bending region is characteristic in the way that for example the bending shown in FIG. 2 remains standing as a permanent deformation due to the fact that the plate is of iron, which is a metal that can be formed with permanent deformations, and that the bending, due to the same reason, would be able to carry significant loads, which might affect the plate.

It is noted, that the plate also can be made of other materials such as a metal like aluminum. The essential requirement is that the material can be permanently deformed.

The moment of resistance of the bending regions are according to the invention chosen such that the starting plate reasonably can be bent about the bending region, which also for certain must be able to to carry the forces, which it is influenced by in use.

The size of the moment of resistance is decided by the width of the bending region, the distance between the segments and their widths, thickness and quality. Thus, there are more parameters to choose from when the moment of resistance is determined.

Figure 3:
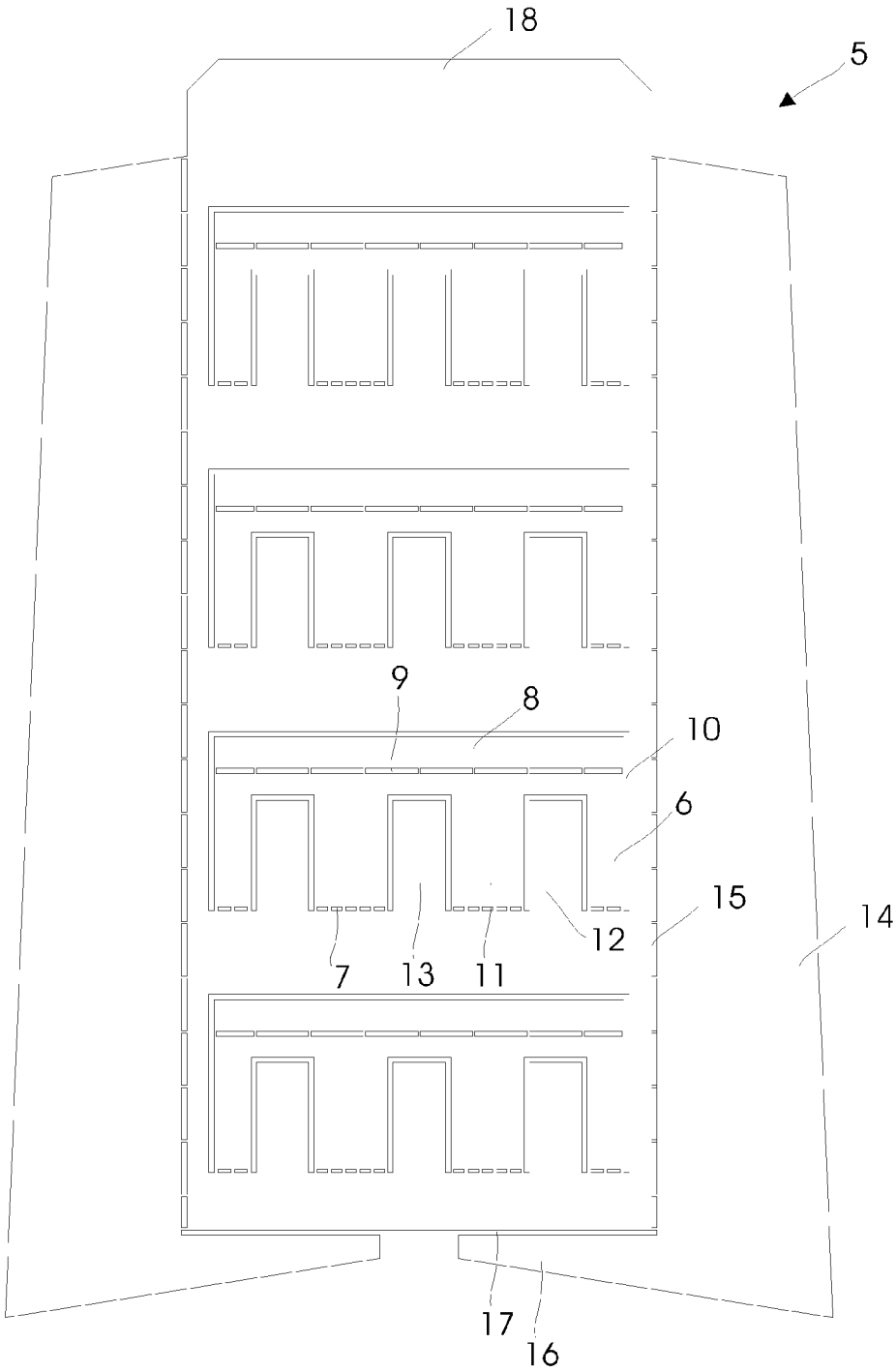
FIG. 3 is a sectional view of a first embodiment of a starting plate according to the invention.

FIG. 3 shows a first embodiment 5 of a starting plate according to the invention corresponding to an exhibition stand in planar condition, where it advantageously will occupy very little space in e.g. a storeroom. The starting plate includes a number of bending regions and openings divided into elements, which form the exhibition stand when the elements are bent about their bending regions in a way which will be described in detail later.

The starting plate has, in the case shown, four shelf elements 6, which each has a side along a bending region 7. Furthermore, each shelf element is connected with a front edge element 8 by means of a bending region 9. A punched opening 10 separates the shelf and the front edge element, 6 and 8 respectively, from the rest of the starting plate.

In the case shown each shelf element is divided into four shelf sections 11, which leaves a rear edge element 12, which is divided into three rear edge sections 13.

On each side of the starting plate there is a side element 14 which is connected to the rest of the starting plate via a bending region 15. Each side element 14 is formed with a flap 16, which extends in the direction of the flap 16 of the other side element 14, and which is separated from the rest of the plate by means of a punched opening or slit 17. Furthermore, the plate is formed with a top element 18.

Figure 4:
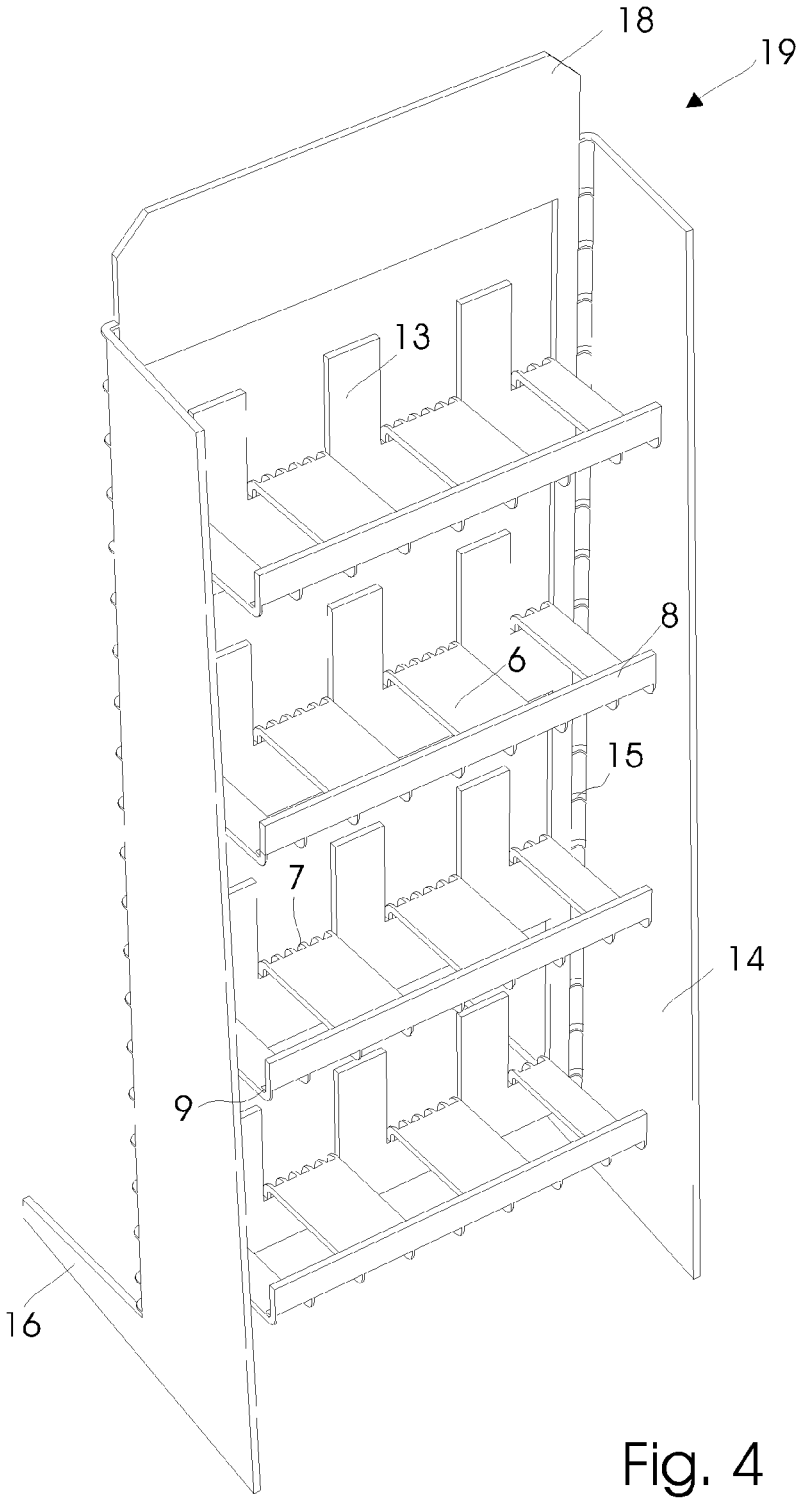
FIG. 4 is a perspective view of a rack, which is formed of the starting plate shown in FIG. 3.

FIG. 4 shows the exhibition stand 19, which is formed when the elements are bent about their bending lines. The various parts of the stand are indicated with the same reference number as in plane state, i.e. as in the corresponding elements in the plate.

As it can be seen, the exhibition stand has four shelves 6 with front edges 8, a top 18 and sides 14 with flaps 16. The exhibition stand is placed on a surface in a slanting position, which ensures that the public has a good overview over the goods (not shown) on the shelves, when the stand is in use. The flaps 16 facing backwards ensure that the slanting exhibition stand does not fall backwards.

Figure 5:
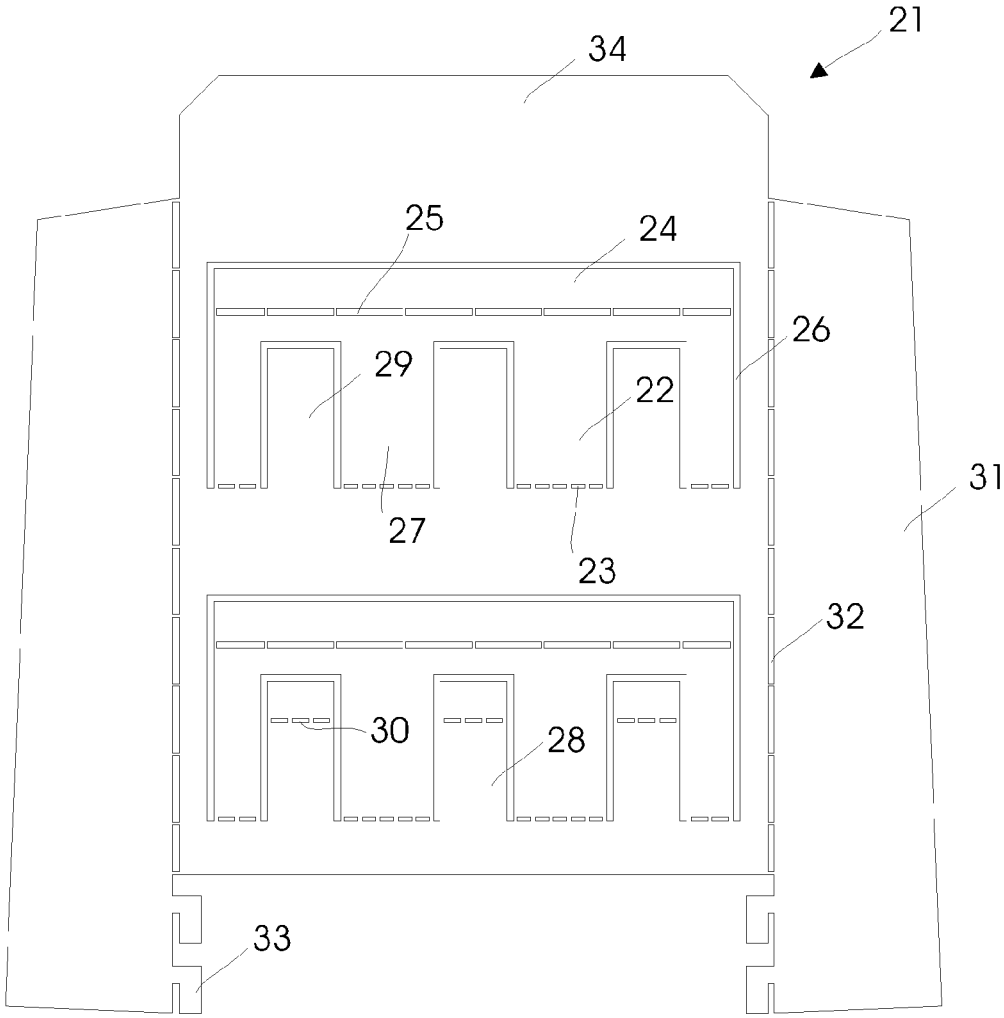
FIG. 5 is a plan view of a second embodiment of a rack according to the invention.

FIG. 5 shows a second embodiment 21 of a starting plate according to the invention with in the case shown two shelf elements 22, which each have a side along a bending region 23. Furthermore, each shelf element is connected with a front edge element 24 via a bending region 25. An opening 26 separates the shelf element and the front edge element, 22 and 24 respectively, from the rest of the plate.

Furthermore, each shelf element is divided into four shelf sections 27 that leave a rear edge element 28, which is divided into three rear edge sections 29.

As it is, the shelf elements and their front and rear edge elements are designed in the same way as the first embodiment 5 of a starting plate according to the invention as shown in FIG. 3, as each of the lowest, seen in the drawings, rear edge sections 29 are fitted with a transverse bending region 30.

Furthermore, each side of the plate has a side element 31 which is connected to the rest of the plate through a bending region 32. Furthermore, each side element is formed with two hooks 33 at the bottom, and at the top the plate has a top element 34.

Figure 6:
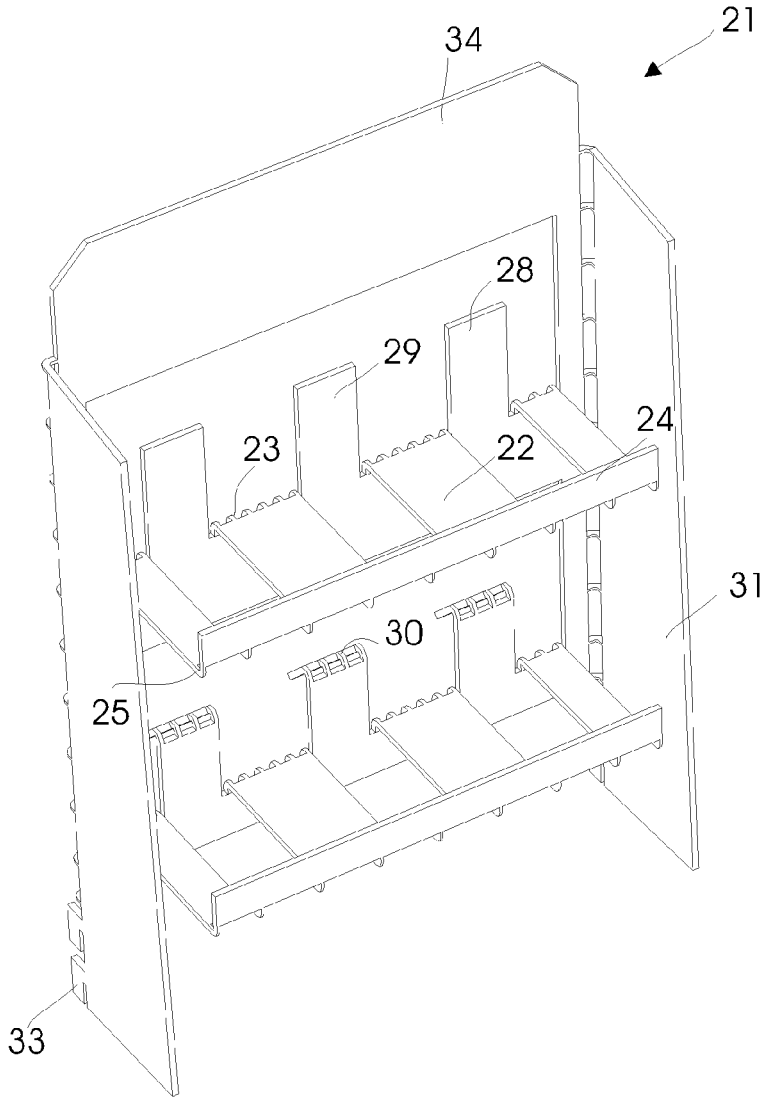
FIG. 6 is a perspective view of a rack, which is formed of the starting plate shown in FIG. 5.

FIG. 6 shows the exhibition stand 21, which is formed when the elements is bent about their bending lines. The various parts of the stand are indicated with same reference number as in plane state, i.e. as in the corresponding elements in the plate.

In this second embodiment the exhibition stand has two shelves 22 with front edges 24, a top 34 and sides 31 with hooks 33. The stand is primarily used to increase the height of the first embodiment 19 of the exhibition stand according to the invention shown in FIG. 4.

Figure 7:
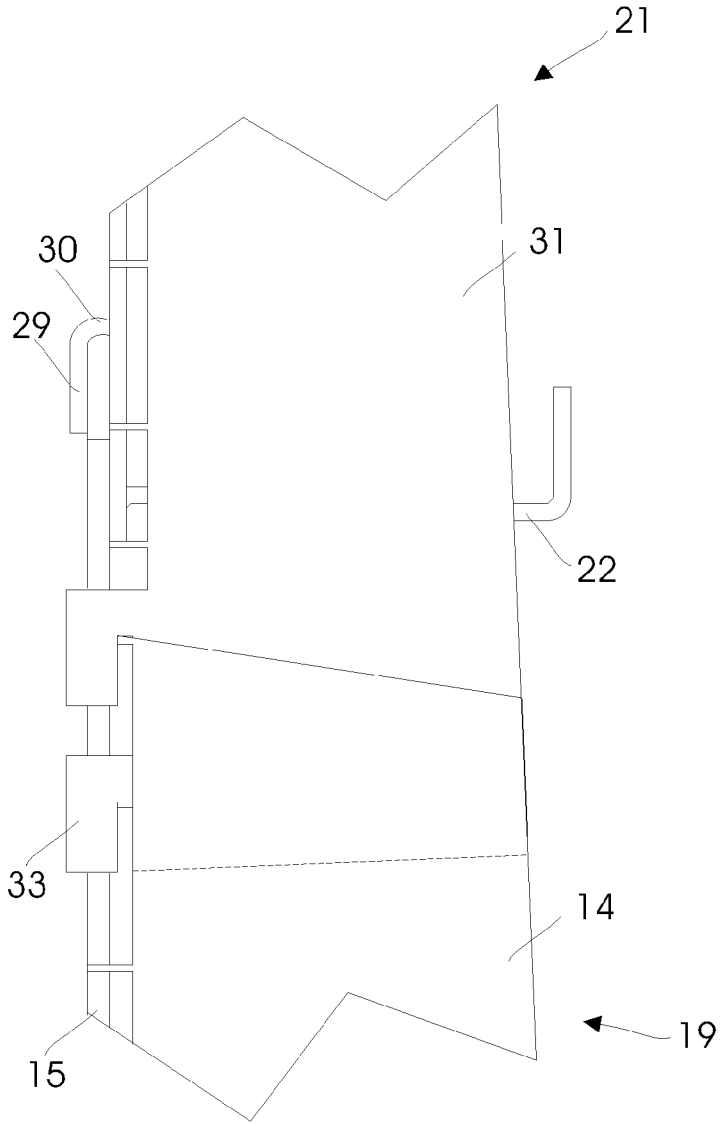
FIG. 7 is a fragmentarily, sectional view, seen from the side, of an assembly according to the invention of two racks, which are formed by the starting plate shown in FIG. 3 and FIG. 5 respectively.

In FIG. 7 the two exhibition stands 19 and 21 are fitted on top of each other with the hooks 33 of the upper stand 21 hooked at the top of the bending region 15 of the lower stand 19 and the lowest rear edge sections 29 on the upper stand 21 bent about the top 18 of the lower stand 19 via the transverse bending regions 30 of the rear edge sections 29. This operation is quick and easy to perform and thereby a strong and stable assembly of the two stands is achieved, which assembled form one tall exhibition stand.

FIG. 8-11 show the principle of the invention, which consists of quick and easy transformation of a blank in the form of a starting plate, which occupies very little space in for example a storeroom, for a rack, which is immediately ready for use.

Figures 8, 9, 10, 11:
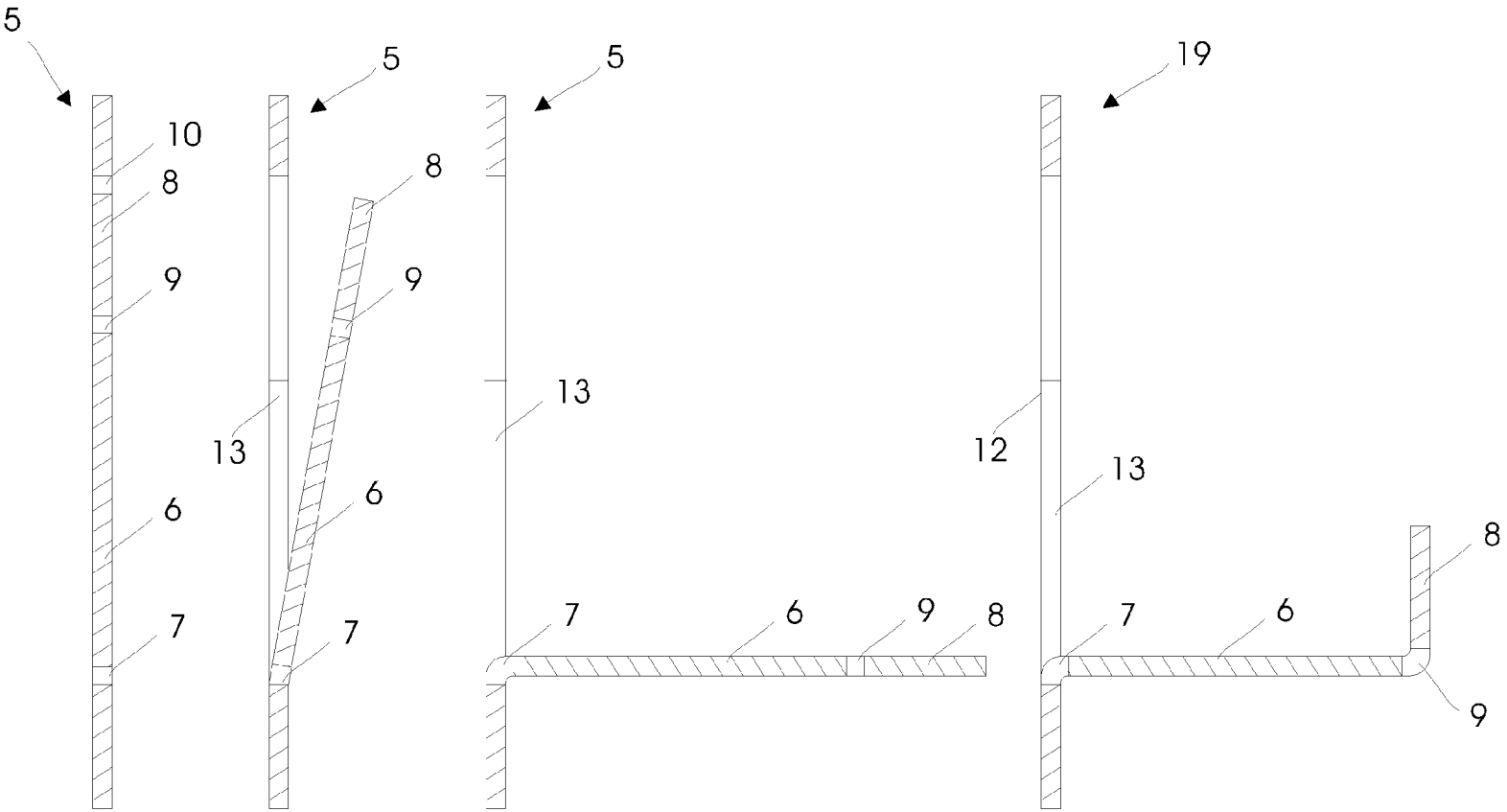
FIG. 8 is sectional side view of a section of the rack shown in FIG. 4.
FIG. 9 is the same view as seen in FIG. 8 but with a shelf element partly bent about a bending region.
FIG. 10 is the same view as seen in FIG. 8 but with a shelf element bent 90°
FIG. 11 is a view of the completely bended shelf on the rack with a front edge bent 90° about a bending region.

FIG. 8 is a sectional view of the plate 5 shown in FIG. 3 with a shelf element 6 and a bending region 7 for the shelf element as well as the front edge element 8 and a bending region 9 for the front edge element.

In FIG. 9 the shelf element 6 is being bent about its bending region 7. The rear edge section 13 is now visible.

In FIG. 10 the shelf element 6 is now bent about its bending region 7 to the end position in the finished exhibition stand.

In FIG. 11 the front edge element 8 is bent about the bending region 9 to the end position with respect to the shelf element 6. A shelf 6 has now been formed with a front edge 8 and a rear edge 12 in an exhibition stand 19.

Figure 12:
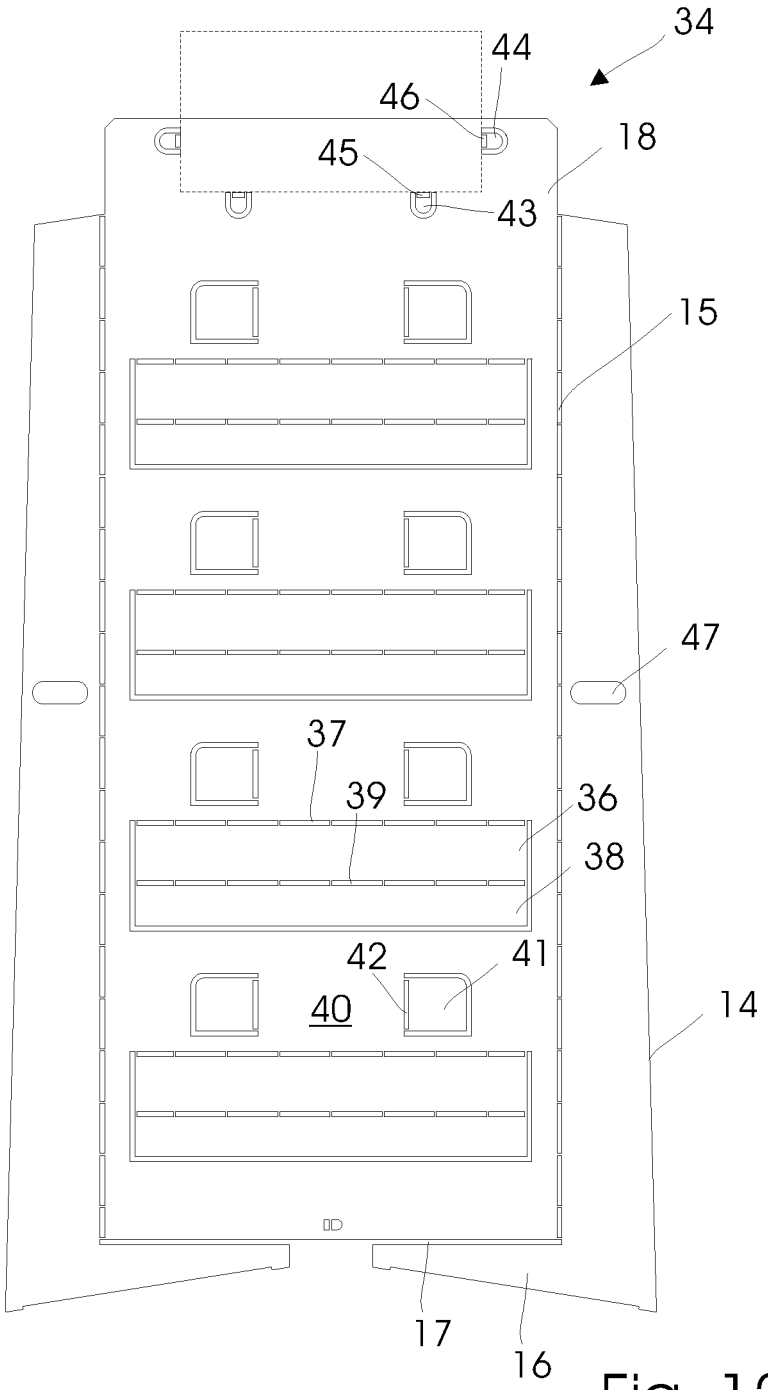
FIG. 12 is a plan view of a third embodiment of a starting plate according to the invention.
Figure 13:
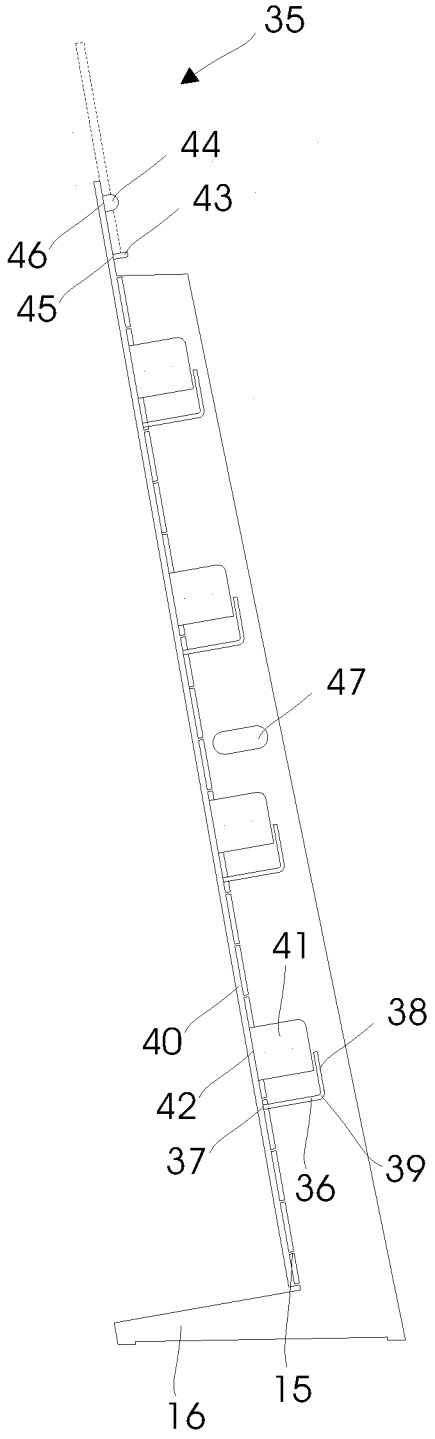
FIG. 13 is a side view of a rack, which is formed of the starting plate shown in FIG. 12.

FIGS. 12 and 13 show a third embodiment according to the invention of a starting plate 34 and a rack 35, respectively, which are folded out of the starting plate. This embodiment corresponds substantially to the first embodiment shown in FIG. 3. Thus, the same reference numbers are used for like parts.

The shelf elements 36 of the rack are each unfolded to shelves about one, viewed in the vertical position of the rack, upper bending region 37. A front edge 38 on each shelf element is folded about a bending region 39 on the shelf element.

There is a plate region 40 between the shelf elements which forms a rear edge 40 for the unfolded shelves.

This embodiment is preferred as shelves and rear edges are without the openings shown in FIGS. 3 and 4. Thus, the unfolded rack can be used for smaller objects that would fall through the mentioned openings.

The third embodiment comprises dividing elements 41 used as dividing walls when unfolded to divide each shelf into smaller compartments. Each dividing element is unfolded about an substantially vertical bending region 42.

This rack is also suited as a bookcase. When unfolded the dividing walls will then advantageously form book supports.

The rack is for example used in department stores that present goods by use of the racks, which then function as sales racks.

In the case shown in FIGS. 12 and 13 a sign indicated by a dotted line is placed at the top of the rack for advertising the goods. The sign is detachable attached by means of horizontal holders 43 and vertical holders 44.

Each holder is formed of a holder element 43 or 44 that can be folded about the bending regions 45 and 46 respectively. The holders can each be bent more than 90° about the corresponding bending region to thereby securely holding the sign in place.

Each side element 14 is fitted with an oblong opening 47, which is fitted to a hand. The rack can easily be moved by holding in these openings.

The above mentioned sign can for example be of cardboard or paper. Cardboard is self-supporting while paper is too flexible for securely to remain on the rack.

On the other hand it is easy and quick to print a clear and easy-to-read message on paper by way of e.g. a computer and a printer.

The printed paper can then be fitted in a suitable pocket (not shown) which is then fitted on the rack by way of holders 43 and 44.

Alternatively the pocket can be fitted with hooks (not shown) for hooking the pocket to the upper edge of the racks shown in FIG. 3, 4 or 6.

Figure 14:
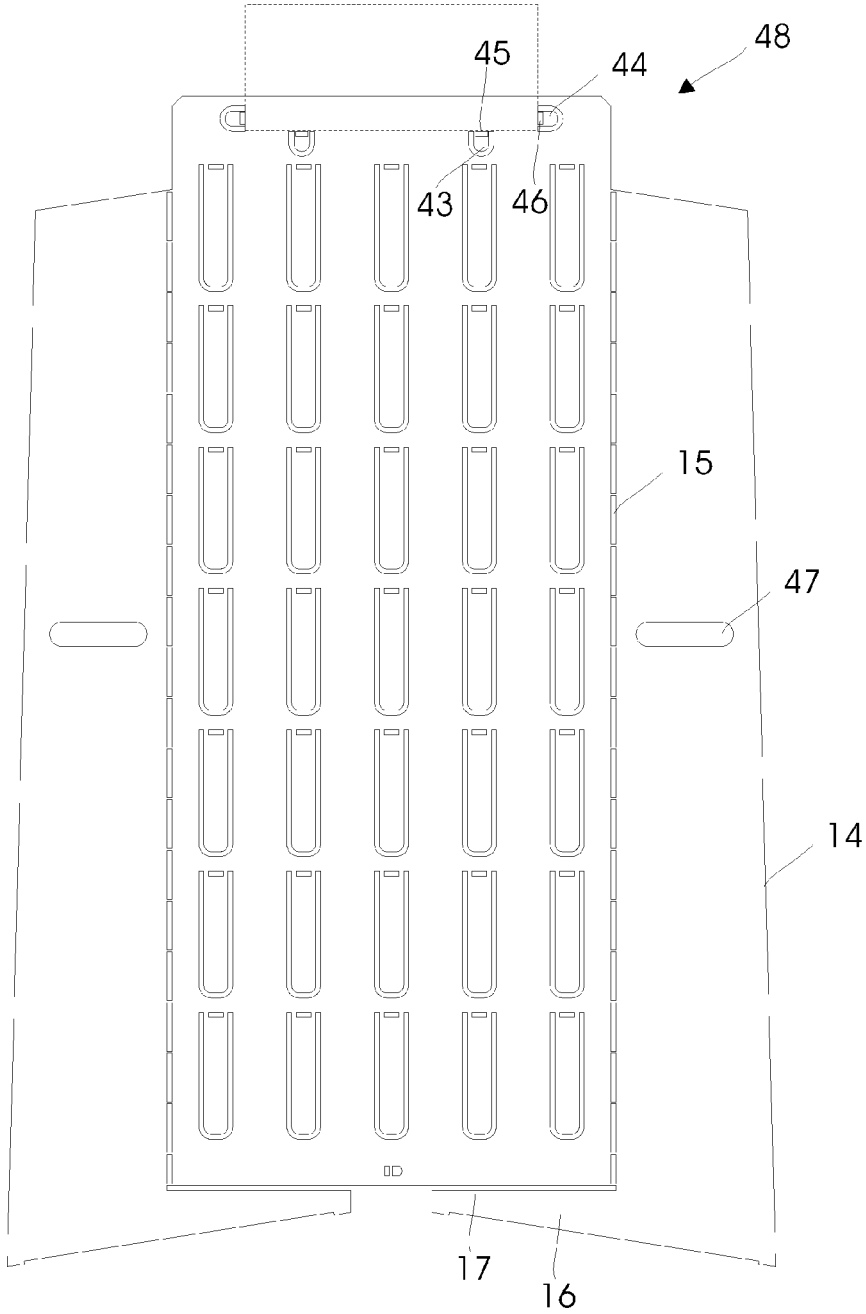
FIG. 14 is a plan view of a fourth embodiment of a starting plate according to the invention.
Figure 15:
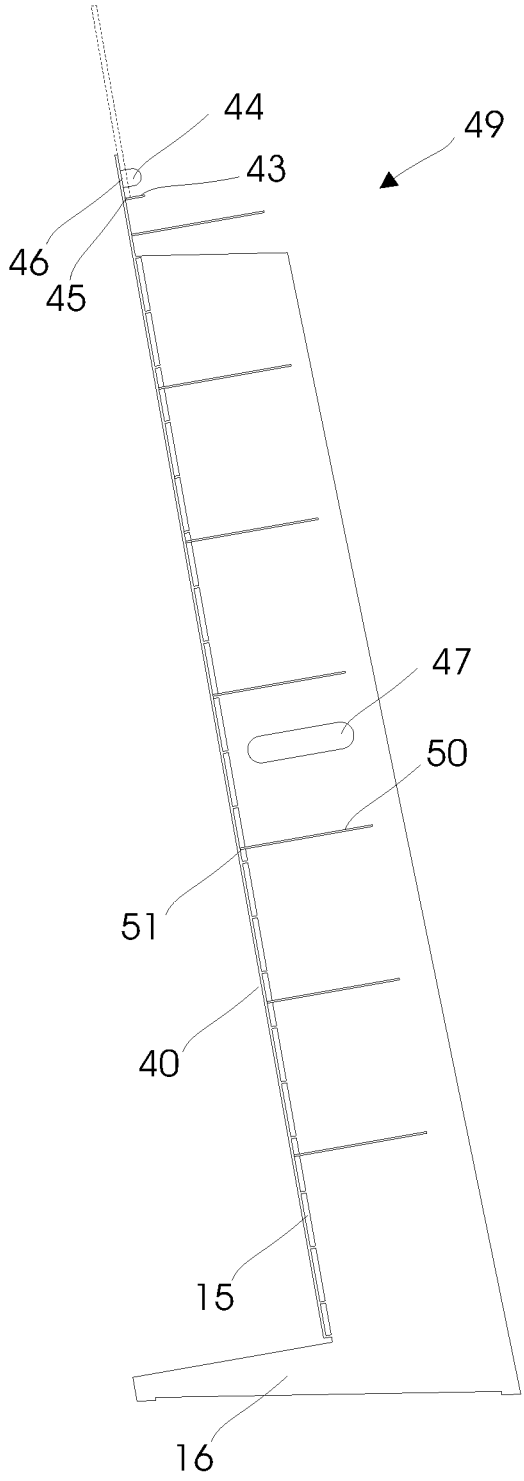
FIG. 15 is a side view of a rack, which is formed of the starting plate shown in FIG. 14.

FIGS. 14 and 15 show a fourth embodiment according to the invention for a starting plate 48 and rack 49 respectively, which are unfolded of the starting plate. This embodiment corresponds substantially to the third embodiment shown in FIGS. 13 and 14. Thus, same reference numbers are used for like parts.

This embodiment consists of a total of seven rows of narrow shelf elements 50, which when unfolded form long narrow shelves formed like hooks.

The unfolded rack forms a display for presentation of objects that are designed to be hooked on the hooks by way of for example a hole in the object.

As an example of such objects are bags with small items such as screws or pastilles.

Each element 50 is unfolded about a horizontal bending region 51.

Embodiments are described above and shown on the drawing of blanks or starting plates and of the unfolded exhibition stands or racks, which each are fitted with a number of various unfoldable elements.

Said various elements can within the frame of the invention be combined in such a way that additional expedient embodiments are formed.

The size of each of the bending of the various elements about their bending regions can be 90° but can also be of a different suitable size.

Each bending region must be sufficiently strong to be able to carry the loads, which it is exposed to in use, and at the same time be able to be bent manually with little difficulty.

The size of the moment of resistance of the bending regions is determined as previously mentioned by the width of the respective bending region, the distance between the segments, theirs widths and the thickness and quality of the iron plate.

EXAMPLE

An exhibition stand of the configuration shown in FIG. 4 was produced by a plate with the pattern shown in FIG. 3. It took approximately 30 seconds. The plate was of ordinary iron and had a thickness of 1.5 mm.

The bending region of each shelf had the following dimensions:

| | |
|---|---|
| Width of the bending region | 3 mm |
| Spacing between the segments | 14 mm |
| Width of each segment | 3 mm |

The shelf had a length of 390 mm and a width of 130 mm and was able to carry objects such as e.g. goods with a total weight of approximately 15 kg.

The shelf was bent about its bending region by pulling in a region at the front edge of the shelf with approximately 10 kg.

The front edge of each bending region had the following dimensions:

| | |
|---|---|
| Width of the bending region | 5 mm |
| Spacing between the segments | 52 mm |
| Width of each segment | 2 mm |

The bending region of each side has the following dimensions:

| | |
|---|---|
| Width of the bending region | 5 mm |
| Spacing between the segments | 52 mm |
| Width of each segment | 2 mm |

What is claimed is:

1. A blank in the form of a starting plate which can be folded into a rack with sides and shelves, said starting plate made of a permanently deformable material and formed with side elements and shelf elements connected each along one side to a remainder of the starting plate by a bending region in the form of a number of segments and openings, while at least one remaining sides of each side element and each shelf element is free, whereby the rack is folded by bending the side elements and the shelf elements about their respective bending regions so that the side elements become the sides of the rack which are perpendicular to the remainder of the starting plate and the shelf elements become the shelves, each shelf being formed as a cantilevered bar restrained by its associated bending region, wherein each side element includes a flap separated from the remainder of the starting plate by a slit whereby when the starting plate is folded into a rack the flaps extend from the remainder of the starting plate in a direction opposite the shelf elements and a remainder of the side elements for support against a surface for the rack.

2. The blank according to claim 1, wherein at least one of the side elements is fitted with an oblong opening that fits a hand.

3. The blank according to claim 1, wherein the bending region of the shelves is designed with a moment of resistance which is equal to or larger than a bending moment which the bending region is influenced by when the shelf is loaded with a predetermined maximal load divided by the maximum allowed specific strain for the material concerned.

4. The blank according to claim 1, wherein the bending regions of the shelf elements are upper bending regions as seen in the upright position of the rack.

5. The blank according to claim 1, wherein a rear edge of each shelf element of the starting plate is formed by a plate region between the shelf elements.

6. The blank according to claim 1, wherein the shelf elements each leave at least one rear edge element which is divided in sections in the starting plate when the at least one shelf element is bent about its bending region and that the rear edge elements form a rear edge for the shelves.

7. The blank according to claim 1, wherein at least one of the shelf elements is connected to a front edge element via a second bending region at which bending about the second bending region forms a front edge.

8. The blank according to claim 1, wherein the bending region of each shelf element is formed with a larger moment of resistance against bending than the other bending regions.

9. The blank according to claim 1, which further comprises dividing elements which in a folded state separate as dividing walls each of the shelves into a plurality of compartments.

10. The blank according to claim 1, which further comprises holders which in a folded state form holders for a sign.

11. A blank in the form of a starting plate which can be folded into a rack with sides and shelves, said starting plate made of a permanently deformable material and formed with side elements and shelf elements connected each along one side to a remainder of the starting plate by a bending region in the form of a number of segments and openings, while at least one remaining side of each side element and each shelf element is free, whereby the rack is folded by bending the side elements and the shelf elements about their respective bending regions so that the side elements become the sides of the rack and the shelf elements become the shelves, each shelf being formed as a cantilevered bar restrained in its associated bending region, wherein the bending regions of the shelf elements are upper bending regions as seen in the upright position of the rack while restraining a rear edge element that includes a plurality of rear edge sections, and wherein the bending region belonging to each shelf is designed with a moment of resistance which is equal to or larger than a bending moment which the bending region is influenced by when the shelf is loaded with a predetermined maximal load divided by the maximum allowed specific strain for the material concerned, wherein each side element includes a flap separated from the remainder of the starting plate by a slit whereby when the starting plate is folded into a rack the flaps extend from the remainder of the starting plate in a direction opposite the shelf elements and a remainder of the side elements for support against a surface for the rack.

12. The blank according to claim 11, which further comprises holders which in a folded state form holders for a sign.

13. The blank according to claim 11 which further comprises dividing elements which in a folded state separate as dividing walls of the shelves to form a plurality of compartments.

14. The blank according to claim 11, wherein the side elements become the sides of the rack perpendicular to the remainder of the starting plate.

* * * * *

UNITED STATES PATENT AND TRADEMARK OFFICE

CERTIFICATE OF CORRECTION

PATENT NO. : 8,540,091 B2
APPLICATION NO. : 12/282335
DATED : September 24, 2013
INVENTOR(S) : Kristensen It is certified that error appears in the above-identified patent and that said Letters Patent is hereby corrected as shown below:

In the Specification

Column 1:
Line 40, change “de limiting” to -- delimiting --.

Column 2:
Line 60, change “advantageously” to -- advantageous --.

Column 4:
Line 9, delete the second occurrence of the word “to”.

In the Claims

Column 7:
Line 36 (claim 1), change “sides” to -- side --.

Signed and Sealed this
Nineteenth Day of November, 2013

Teresa Stanek Rea
*Deputy Director of the United States Patent and Trademark Office*